US005946804A

United States Patent [19]

Alderman

[11] Patent Number: 5,946,804

[45] Date of Patent: Sep. 7, 1999

[54] APPARATUS FOR STRAIGHTENING PURLIN BEAMS OF A ROOF STRUCTURE

[75] Inventor: Robert J. Alderman, Canyon Lake, Tex.

[73] Assignee: Owens Corning Fiberglas Technology, Inc., Summit, Ill.

[21] Appl. No.: 09/016,703

[22] Filed: Jan. 30, 1998

[51] Int. Cl.[6] ..... B23P 15/00

[52] U.S. Cl. ..... 29/897.1; 29/402.01; 29/402.19; 52/749.12; 72/316

[58] Field of Search ..... 29/281.6, 281.5, 29/700, 402.01, 402.19, 897.1; 72/446, 306, 316, 385; 52/749, 749.12

[56] References Cited

U.S. PATENT DOCUMENTS

| | | | |
|---|---|---|---|
| 3,983,676 | 10/1976 | Gilpin | 52/749.12 |
| 4,075,807 | 2/1978 | Alderman . | |
| 4,356,716 | 11/1982 | Aschauer | 72/306 |
| 4,967,535 | 11/1990 | Alderman . | |
| 4,993,207 | 2/1991 | Burke | 52/749.12 |
| 5,259,166 | 11/1993 | Carey, II et al. | 52/749.12 |
| 5,303,572 | 4/1994 | Knudson | 72/385 |
| 5,343,727 | 9/1994 | Osaka | 72/306 |
| 5,495,698 | 3/1996 | Alderman et al. | 52/749.12 |
| 5,623,805 | 4/1997 | Morello | 52/749.1 |
| 5,653,081 | 8/1997 | Wenrick et al. . | |

*Primary Examiner*—Irene Cuda
*Assistant Examiner*—Nguyen T. Trinh
*Attorney, Agent, or Firm*—Inger H. Eckert; Stephen W. Barns

[57] ABSTRACT

An apparatus for straightening portions of a plurality of purlins of a roof structure which have been moved from an original position to a deformed position and a method of using the same is disclosed. A carriage is provided which is mounted for movement along the length of the purlins in a downstream direction. The carriage has a plurality of guides which are positioned adjacent the plurality of purlins in the deformed position. A purlin straightening device attached to the carriage moves the carriage in a direction lateral to the length of the purlins so that the guides move the portions of the plurality of purlins from the deformed position to the original position.

7 Claims, 3 Drawing Sheets

APPARATUS FOR STRAIGHTENING PURLIN BEAMS OF A ROOF STRUCTURE

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

Some roof structures have bracing or sag rods extending between adjacent purlins to provide rigidity to the purlin beams. The bracing includes elongated bars or straps which are fastened to adjacent purlins. The bracing is commonly attached to the vertical portions of the purlins and can extend from the bottom of one purlin to the top of an adjacent purlin. Thus, bracing provides a certain amount of rigidity to the roof structure so that purlins do not bend or twist with respect to one another. Although bracing can provide rigidity to the purlins, the presence of the bracing can interfere with the insulation material placed in the space between the purlins. The insulation material may be compressed around the regions of the bracing, thereby reducing the overall thermal or R value of the roof structure. In a roof structure in which the hard roofing material is directly fastened to the purlins, the bracing generally no longer serves the purpose of providing required rigidity to the purlins in the final roof structure. The cooperation of the attached hard roofing material, purlins, and rafter beams provides for a relatively strong structure, wherein the purlins are unlikely to bend or deform. Thus, for these types of roof structures, the bracing mainly provides support during construction of the roof.

The insulation material is supported between the purlins beneath the hard roofing material. Various methods of supporting the insulation material have been used. Mounting straps or wire mesh which are attached to or draped over the purlins forming a lattice have been used. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins.

The purlin beams, which are mounted on and positioned above the rafter beams, can have various cross-sectional shapes, but typically have a Z-shaped or I-shaped cross-section. In some instances due to the weight of the workers standing on a completed section of the roof or due to the weight of the carriage, the purlins can be bent or deformed from their original shape to a deformed shape. For example, a Z-shaped purlin generally has a planar upper horizontal portion which is perpendicular to a planar vertical web which is perpendicular to a planar lower horizontal portion when the Z-shaped purlin is in an original position. The Z-shaped purlin may be deformed such that the angle between the upper horizontal portion and the vertical web and the angle between the vertical web and the lower horizontal portion are each greater than 90 degrees such that the vertical web is no longer oriented in a vertical plane. Thus, the purlin has a slanted Z-shaped cross-section. Deformed purlins are undesirable due to complications which can arise when the sheets of hard roofing material are fastened to the purlins.

It would be desirable to have an apparatus and method of straightening purlins of a roof structure which have been deformed from an original position to a deformed position which is inexpensive and simple to perform, and which may eliminate the need for extensive bracing.

SUMMARY OF THE INVENTION

The above objects as well as other objects not specifically enumerated are achieved by an apparatus and a method of using the same for straightening a plurality of purlins spaced apart from one another in a parallel arrangement which have been moved from an original position to a deformed position. The apparatus and method provides for an inexpensive and simple system for straightening the plurality of purlins.

In a roof structure, a plurality of purlins are spaced apart from one another in a parallel arrangement and are supported by a plurality of rafter beams extending in a parallel arrangement in a direction normal to the purlins. A carriage is provided which is adapted to move along the length of the purlins in a downstream direction. The carriage is mounted for movement along the length of the purlins. The carriage includes a plurality of guides which prevent the carriage from moving in a lateral direction with respect to the purlins so that the carriage travels accurately along the length of the purlins and the longitudinal edges of the support sheet are dispensed evenly across the respective upper portions of the purlins. The carriage includes a purlin straightening device which is adapted to move the carriage in a direction lateral to the purlins. As the carriage moves in the lateral direction, the guides push against the purlins, thereby moving them from the deformed position back to their original position.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
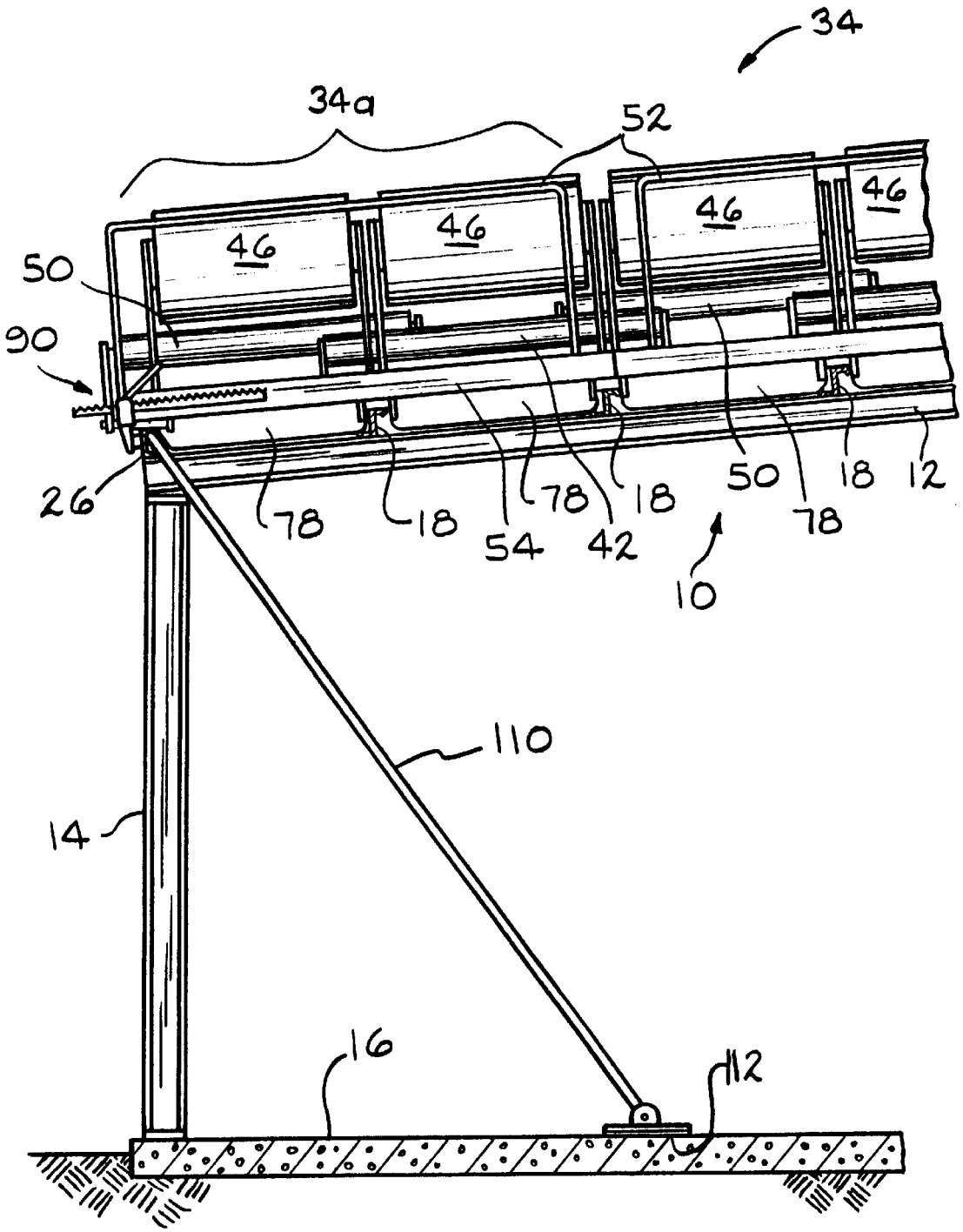
FIG. 1 is a schematic elevational end view of a carriage on top of a roof structure, wherein the carriage has a purlin straightening device mounted thereon for straightening a plurality of deformed purlins, in accordance with the present invention.
Figure 2:
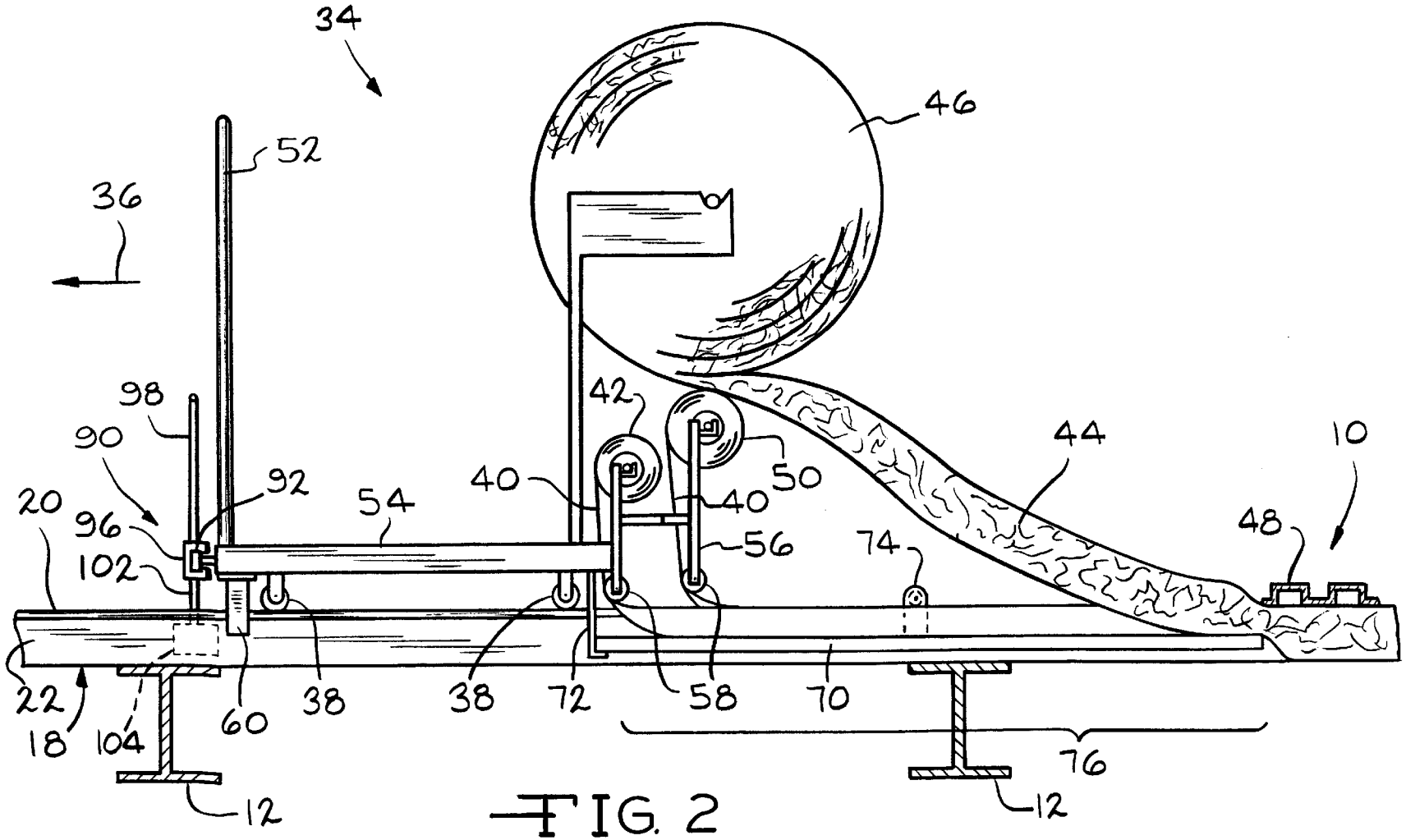
FIG. 2 is a schematic elevational side view of the carriage of FIG. 1.
Figure 3:
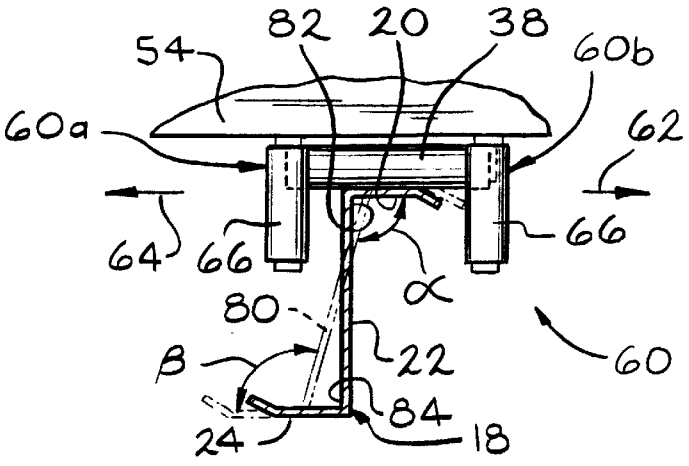
FIG. 3 is an enlarged schematic elevational view of one of the rollers and pair of guides of the carriage of FIG. 1, illustrating the positioning of the rollers and the guides with respect to a Z-shaped purlin.

Referring to FIGS. 1 and 2, there is illustrated a partially completed building roof structure, indicated generally at 10. The roof structure is supported by a building framework which includes main rafter beams 12 positioned parallel to each other and supported by vertical column beams 14 extending upward from a floor 16. A plurality of purlins 18, spaced apart and arranged parallel to each other, is fastened on top of the rafters in a direction normal to the rafters. The building framework may have two sloped roof sides (one of which is shown in FIG. 1) which are joined together to form a peak (not shown). Thus, the framework has successive adjacent purlins which are positioned lower than the peak as their distance from the peak increases. The sloped roof sides generally provide for rain and snow drainage. The spacing of the purlins is typically 5 feet (1.52 m) on centers. As best shown in FIG. 3, the purlins typically have a generally Z-shaped cross-section, and include a horizontally extending upper portion 20, a vertically extending web 22, and a horizontally extending lower portion 24.

Figure 4:
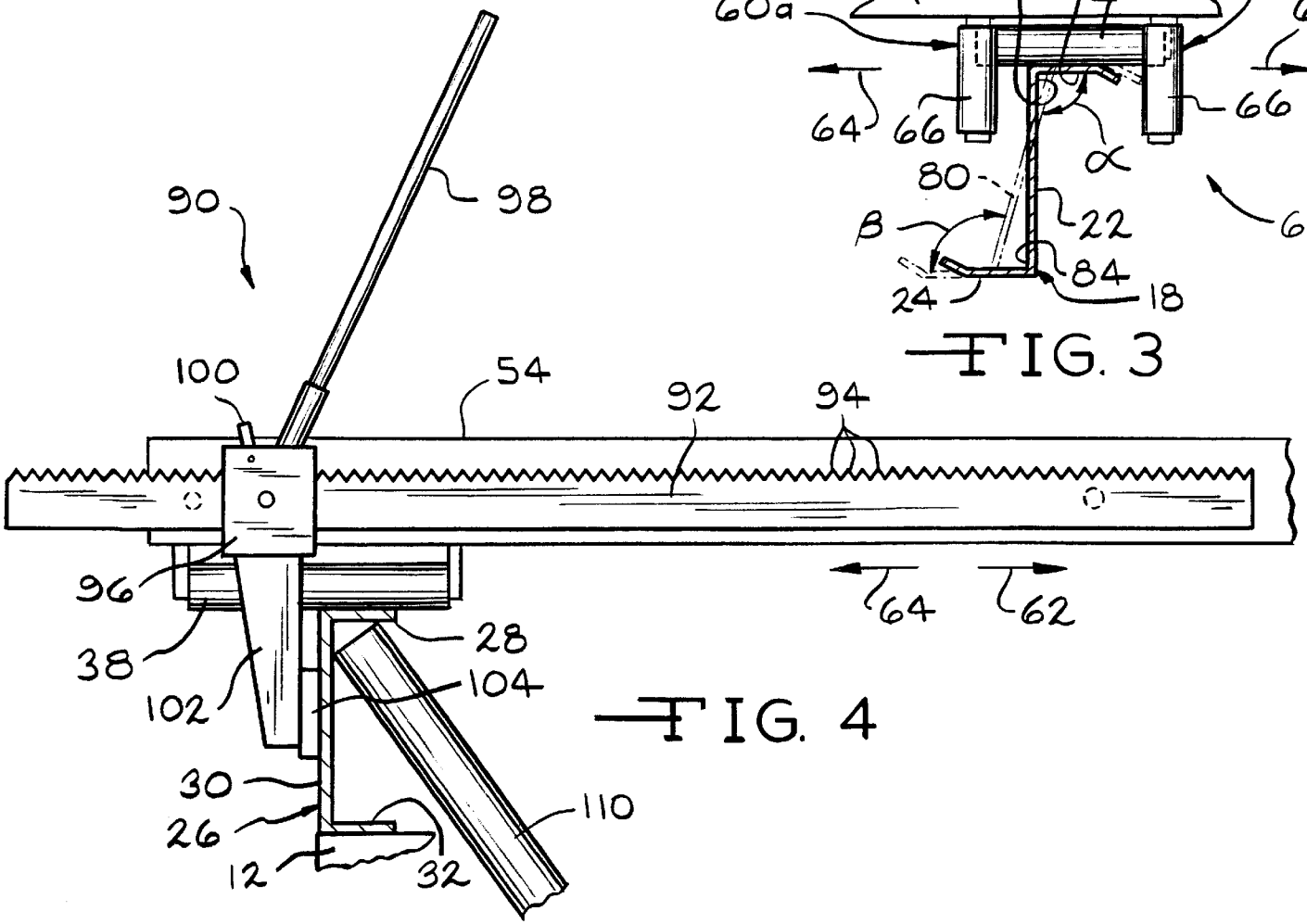
FIG. 4 is an enlarged schematic elevational view of the purlin straightening device of the carriage of FIG. 1.

Typically, the side of the roof structure has an eave strut 26 having a C-shaped cross-section, as best seen in FIG. 4, which is fastened to the rafters and extends parallel to the purlins. The C-shaped eave strut includes a horizontally extending upper portion 28, a vertically extending web 30, and a horizontally extending lower portion 32. Roof structures may also be constructed from bar joists or trusses, and the invention as described herein will work equally well with purlins, bar joists or trusses. The use of the term "purlins" in this specification and claims includes not only traditional purlins, but also joists, trusses, and other similar structural members.

Broadly stated, the roof structure is constructed by use of a carriage 34 which rides on the upper portion 20 of the purlins and travels along the length of the purlins in a downstream direction, represented by an arrow 36, as shown in FIG. 2. Preferably, the carriage has rollers 38 rotatably mounted on the carriage which roll along the upper portions of the purlins. As the carriage is moved, a support sheet 40 is payed out from a roll 42. The support sheet is draped on top of adjacent purlins so that the support sheet depends from the upper portion of the purlins. The support sheet supports a layer of insulation material 44 which is placed on top of the support sheet between the adjacent purlins. The insulation material is typically dispensed from a roll 46 but can be applied by any suitable manner, such as by applying insulation batts on top of the support sheet. Alternatively, a layer of insulation may be placed laterally across the purlins. After the insulation material has been placed on the support sheet, long sheets of hard roofing material 48, such as metal roof decking, are then attached to the upper portion of the purlins over the support sheet and insulation. The hard roofing material can be fastened to the purlins in any suitable manner, such as by threaded fasteners or clips. The attachment of the hard roofing material presses down on the edges of the support sheet which are sandwiched between the upper portion 20 of the purlins and the hard roofing material 48, so that the support sheet supports the insulation between the purlins.

Because the hard roofing material comes in long sheets, typically 30 to 35 feet (9.1 to 10.7 m), and the roofs generally have two sloped roof sides, it is customary to construct a first section of the roof structure along the width of the sloped roof side and then proceed along the length of the structure from one end to the other. The workers stand on the previously attached first section of the roof structure to assemble the next section of roof. The carriage travels along the length of the purlins and is moved by the workers as each new section of roof is assembled.

The carriage can be any length up to the width of the roof itself. As shown in FIG. 1, the carriage is comprised of a plurality of carriage sections 34*a* which can be joined together so that they span the entire width of the sloped section of the roof. The carriage is then propelled across the purlins by pulling means, such as winches (not shown), in the downstream direction 36 so that all the carriage sections move in unison. Because the support sheet is draped across the upper portion of adjacent purlins, the total width of the support sheet is wider than the distance between the purlins. Therefore, adjacent support sheet rolls are not co-linear and must be slightly staggered. Typically, a carriage section 34*a* covers two purlin spans, i.e., about 10 feet (3.3 m) in length. Therefore, each carriage section preferably has both a leading roll 42 and a trailing roll 50 of insulation support sheet, one roll for each of two adjacent purlin spans. The edge of the support sheet from the trailing roll 50 will be draped on top of the edge of the support sheet from the leading roll 42 as the carriage moves in the downstream direction. Multiple identical carriage sections 34*a* having a leading and trailing roll can, therefore, be joined together, with every roll being staggered from an adjacent roll.

The carriage 34 can be any suitable apparatus which moves along the top of the purlins and dispenses the support sheet. As seen from FIG. 2, the carriage preferably includes safety handrails 52 and a deck 54 for the worker to stand on while operating or moving the carriage. The rollers 38 are mounted from the deck 54 of the carriage. Preferably, the carriage is equipped with two rollers (front and rear) for each purlin, as shown in FIG. 2. The carriage also includes a framework 56 for mounting the rolls 42 and 50. In FIG. 1 the leading roll 42 is shown in the foreground, and the trailing roll 50 is shown in the background. Mounted on the framework are turning bars 58 which extend laterally across associated support sheets and are positioned slightly above the upper portions 20 of the purlins 18 so as to direct the support sheet to a generally horizontal position.

The carriage includes a plurality of guides, indicated generally at 60, which extend downwardly from the deck 54 and are positioned adjacent the purlins 18. The guides prevent the carriage from moving in a lateral direction with respect to the purlins so that the carriage travels accurately along the length of the purlins and the longitudinal edges of the support sheet are dispensed evenly across the respective upper portions of the purlins. Preferably, the guides include first and second guide members 60*a* and 60*b* which are positioned on either side of a purlin. The guide member 60*a* prevents the carriage from moving in a first lateral direction, represented by the arrow 62 in FIG. 3. The second guide member 60*b* prevents the carriage from moving in a second lateral direction, represented by the arrow 64 in FIG. 3. Preferably, the first and second guide members include rotatably mounted rollers 66 for rolling engagement between the respective guide member and the purlin.

Attached to the carriage is an optional plate 70 which extends from the carriage in an upstream direction which is opposite the downstream direction 36. The plate supports the payed out portion of the support sheet and insulation material so that the support sheet does not drape downwardly, thereby pulling the longitudinal edges of the support sheet off the upper portion of the purlins. If sufficiently built, the plate can be used for fall protection for the workers to prevent them from falling off the leading edge of the previously completed section of roof. The plate can be attached to the carriage by any suitable means, but preferably is attached to the carriage by a plurality of hooks 72 which vertically extend from the plate and hang on the carriage, thus attaching one end of the plate to the carriage. The plate follows the carriage as the carriage moves along the length of the purlins. Preferably, the plate has wheels 74 which support the other end of the plate by rolling along the upper portion of the purlins 18. However, it is not required that the payed out support sheet be supported by the plate. The carriage could be modified so that the support sheet is payed out so that the support sheet is underneath the plate. If desired, the roll 46 of insulation material 44 could be positioned on the plate 70 above the support sheet. Generally, the plate is located in a gap 76 which exists between the completed section of the roof structure 10 and the carriage 34. The plate hinders wind from blowing vertically through the gap 76 and thus, disturbing the insulation material 44 and the support sheet 40.

The space between the vertical webs 22 of adjacent purlins 18 defines an insulation cavity 78, as shown in FIG. 1. The insulation cavity has a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. The support sheet can be of any suitable material for the stated purposes, such as vinyl or foil faced paper.

Under certain circumstances due to the weight of the workers standing on a completed section of the roof or due to the weight of the carriage, various portions of the length of purlins can be bent or deformed from their original shape. For example, in an original position of a purlin having a Z-shaped cross-section, the upper portion 20 generally defines a plane which is generally perpendicular to a plane defined by the vertical web 22 and the plane defined by the vertical web 22 is generally perpendicular to a plane defined by the lower portion 24, as illustrated in solid lines in FIG. 3. Under certain loads, the Z-shaped purlin has a tendency to deform to a slanted deformed condition or position, as indicated by phantom lines 80 in FIG. 3. Generally, in the deformed position 80, the upper portion 20 of the purlin has rotated with respect to the vertical web 22 about a pivot point 82. Typically, in a deformed position, the plane defined by the upper portion 20 and the plane defined by the vertical web 22 form an angle $\alpha$ which is greater than 90 degrees. Similarly, in the deformed position 80, the vertical web 22 of the purlin has rotated with respect to the lower portion 24 about a pivot point 84. The plane defined by the vertical web 22 and the plane defined by the lower portion 24 form an angle $\beta$ which is greater than 90 degrees. In the deformed position, the vertical web 24 is no longer oriented in a vertically extending plane. Since the lower portion 24 of the purlin 18 is fastened to the rafter beams 12, the upper portion 20 is generally moved in the first lateral direction 62 to obtain the deformed position 80.

Although the illustrated embodiment of the purlin has an upper portion 20 which moves in the second lateral direction 62 back to an original position, in a broader sense, the invention includes movement of any analogous part of a purlin, referred to as first portions of the purlins. For example, the purlin could have an I-shaped cross section, wherein the first portion is an upper flange which moves in the second lateral direction.

To straighten the purlins from their deformed position 80 back to their original position, the carriage includes a purlin straightening device, indicated generally at 90, in accordance with the present invention. The purlin straightening device 90 can be any suitable apparatus which can move the carriage in a lateral direction with respect to the rafter beams 12 to straighten portions of purlins which have been bent to a deformed position. As the carriage moves in the appropriate lateral direction, the guides push against the deformed purlin, forcing the purlins back to their original shape. In the illustrated embodiment shown in FIGS. 1 and 4, the purlin straightening device 90 includes a first actuator portion, such as an elongated rail 92, which is fastened to the deck 54 of the carriage. The rail has a plurality of teeth 94 formed therein. The purlin straightening device further includes a second actuator portion, such as a body 96, which is selectively movable along the length of the rail. The body preferably includes a conventional ratchet assembly (not shown) for engagement with the teeth of the rail so that the body can be operatively moved along the length of the rail and maintained at a desired position along the length of the rail when a reactionary force is applied to the body. A handle 98 is used to manually actuate the ratchet assembly to move the body relative to the rail. The ratchet assembly of the body can include a release tab 100 for releasing the engagement between the ratchet assembly and the rail so that the body can be easily positioned at a desired position along the length of the rail. Extending from the body is an arm 102 which engages a fixed portion of the roof structure, such as the web 30 of the eave strut 26. The arm 102 may include a pad 104 which contacts the web of the eave strut. Preferably, the pad 104 is made of a material having a high coefficient of friction, such as rubber, to provide for a relatively high frictional engagement between the arm and the web of the eave strut to prevent sliding relative to each other.

To straighten portions of purlins which have been deformed from an original position to a deformed position using the purlin straightening device 90, the carriage is first moved so that the guides 60 are positioned adjacent the deformed portions of the purlins. The handle 98 of the purlin straightening device 90 is operated to move the body 96 along the length of the rail 92 until the pad 104 of the arm 102 contacts a fixed portion of the roof, such as the web 30 of the eave strut 26 as shown in FIG. 4. Typically, the eave strut of a building is structurally stronger than the purlins, and can therefore act as a fixed portion of the roof structure. The eave strut can be braced by positioning an elongated member or rod 110 between the eave strut 26 and the floor 16, as shown in FIGS. 1 and 4. The rod 110 is positioned between upper portion 28 and the web 30 of eave strut, as illustrated in FIG. 1, to help prevent the eave strut from rotating in a clockwise direction about the lower portion 32 when a force is acting on the left-hand end of the web 30. The rod 110 can be any suitably strong elongated member, such as a conventional ladder. Preferably, the end of the rod 110 contacting the floor 16, includes a rubber pad 112 for high frictional contact between the end of the rod 110 and the floor 16.

After the pad 104 of the purlin straightening device 90 has contacted the web 30 of the eave strut 26, the handle 98 of the purlin straightening device 90 is further operated so that the body 96 travels with a ratcheted motion along the length of the rail 92 in the first lateral direction 62. Since the cave strut 26 is a fixed portion of the roof structure, the movement of the body 96 with respect to the rail causes the rail and the carriage to move in the second lateral direction 64. Since the guides 60 are fastened to the carriage, the guides also move in the second lateral direction. As shown in FIG. 3, the roller 66 of the second guide member 60b will push against the upper portion 20 of the purlin 18. The purlin straightening device 90 is actuated until the upper portion 20 of the purlin has moved a sufficient distance for the purlin to be moved from its deformed position to the original position. Thus, if a carriage spanning a plurality of deformed purlins has guides 60 adjacent every purlin, the movement of the carriage can straighten the plurality of purlins concurrently.

Since the purlin straightening device 90 in cooperation with the carriage 34 and the guides 60 can straighten purlins as the roof structure is being completed, the need for bracing (not shown) can be significantly reduced or eliminated. Bracing includes the use of bars or straps which are fastened between adjacent purlins. The bracing provides rigidity to the roof structure to assist in preventing the purlins from deforming or bowing with respect to one another. However, extensive bracing can cause substantial interference with the insulation material placed in the insulation cavity. As the support sheet is dispensed, the support sheet must be placed over the bracing, causing compression of insulation material. In addition, bracing is relatively expensive and time consuming to install. Compression of the insulation material lowers the thermal or R value of the roof structure. By using the purlin straightening device 90 in cooperation with the carriage 34 and the guides 60, the amount of bracing can be reduced or eliminated.

Although the purlin straightening device 90 has been described as having a first actuator portion as the rail 92, and a second actuator portion as the body 96 and the arm 102, the first and second actuator portions can be any suitable structures which are adapted to move relative to one another. It should also be understood that any suitable apparatus can be used as a purlin straightening device for moving the carriage in a lateral direction with respect to the rafter beams 12 to straighten portions of purlins which have been bent to a deformed position. For example, a winch and cable system can be used, wherein the winch is connected to the carriage and the cable is attached to a fixed portion of the roof structure, such as the eave strut. The winch can be operated to draw in the length of the cable, thereby pulling the carriage in the second lateral direction.

Although the method of straightening purlins in accordance with the present invention has been described in conjunction with Z-shaped purlins which have been deformed into a slanted Z-shaped cross section, as described above, it should be understood that the present method can be used to straighten purlins which have been deformed into other shapes. For example, the present method of the invention would straighten structural beams which have been torsionally twisted about the longitudinal axis of the elongated structural beam. Additionally, although the method of straightening purlins in accordance with the present invention has been described in conjunction with purlins having a generally Z-shaped cross-section, it should be understood that other various shaped purlins, such as I-shaped or C-shaped, can be straightened from a deformed position back to an original position.

The principle and mode of operation of this invention have been described in its preferred embodiments. However, it should be noted that this invention may be practiced otherwise than as specifically illustrated and described without departing from its scope.

What is claimed is:

1. An apparatus for providing a roof structure of the type having a plurality of purlins spaced apart from one another in a parallel arrangement, the apparatus comprising:

a carriage mounted for movement along the length of the purlins in a downstream direction;

a plurality of guides mounted on the carriage, each guide being positioned adjacent one of the purlins; and a purlin straightening device mounted on the carriage, the straightening device having a first actuator portion fixed to the carriage, and a second actuator portion operatively connected to a fixed portion of the roof structure, wherein actuation of the purlin straightening device causes the carriage to move in a lateral direction perpendicular to the downstream direction, thereby causing the guides to push against and deform the purlins from a first position to a second position.

2. The apparatus of claim 1, wherein the second portion of the purlin straightening device is an arm which is selectively movable in a second lateral direction with respect to the first portion of the purlin straightening device.

3. The apparatus of claim 2, wherein the first portion is an elongated rail, and the arm is engaged to ride along the length of the rail.

4. The apparatus of claim 3, wherein the rail has a plurality of teeth formed thereon, and the second portion includes a ratchet assembly engaging the plurality of teeth.

5. The apparatus of claim 1, wherein the guides have rollers for guiding the carriage as the carriage moves along the length of the purlins in the downstream direction.

6. The apparatus of claim 2, wherein the arm has a rubber pad which frictionally contacts the fixed portion of the roof structure.

7. The apparatus of claim 1, wherein the fixed portion of the roof structure is a structural beam, which further includes an elongated rod positioned between the structural beam and a fixed reference point for bracing the structural beam from movement.

* * * * *